US010753701B2

(12) United States Patent
Jonas, IV et al.

(10) Patent No.: US 10,753,701 B2
(45) Date of Patent: Aug. 25, 2020

(54) ARCHERY BOW STABILIZER

(71) Applicants: Brian H. Hamm, Wisconsin Rapids, WI (US); Chris A. Hamm, Wisconsin Rapids, WI (US)

(72) Inventors: LeRoy W. Jonas, IV, Wausau, WI (US); Brian H. Hamm, Wisconsin Rapids, WI (US); Chris A. Hamm, Wisconsin Rapids, WI (US)

(73) Assignees: Christopher A. Hamm, Wisconsin Rapids, WI (US); Brian H. Hamm, Wisconsin Rapids, WI (US)

( * ) Notice: Subject to any disclaimer, the term of this patent is extended or adjusted under 35 U.S.C. 154(b) by 0 days.

(21) Appl. No.: 16/842,279

(22) Filed: Apr. 7, 2020

(65) Prior Publication Data

US 2020/0232747 A1 Jul. 23, 2020

Related U.S. Application Data

(63) Continuation-in-part of application No. 16/455,321, filed on Jun. 27, 2019, now Pat. No. 10,648,762.

(60) Provisional application No. 62/691,055, filed on Jun. 28, 2018.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89
See application file for complete search history.

(56) References Cited

U.S. PATENT DOCUMENTS 3,468,297 A * 9/1969 Cress ..... F41B 5/1426 124/88
3,683,883 A * 8/1972 Izuta ..... F41B 5/1426 124/89
4,245,612 A * 1/1981 Finlay ..... F41B 5/1426 124/89
4,570,608 A * 2/1986 Masterfield ..... F41B 5/1426 124/89
4,660,538 A * 4/1987 Burgard ..... F41B 5/1426 124/88
4,718,647 A * 1/1988 Ludwig ..... F16F 9/585 188/322.15
4,779,602 A * 10/1988 Hess, Sr. ..... F41B 5/1426 124/88
4,893,606 A * 1/1990 Sisko ..... F41B 5/1426 124/89
4,982,719 A * 1/1991 Haggard ..... F41B 5/1426 124/23.1

(Continued)

OTHER PUBLICATIONS

Beiter article dated Sep. 2005 titled The Beiter Centralizer.

(Continued)

*Primary Examiner* — Alexander R Niconovich
(74) *Attorney, Agent, or Firm* — Sane Delsman; Godfrey & Kahn, S.C.

(57) ABSTRACT

A stabilizer for an archery bow with adjustable weight that, when attached to a bow, permits the center of gravity and balance of the bow to be changed. The stabilizer includes a tubular housing and a knob, frame or shell that may be rotated to move the weight to adjust the center of gravity and balance of the bow.

20 Claims, 12 Drawing Sheets

(56) References Cited

U.S. PATENT DOCUMENTS 4,986,018 A * 1/1991 McDonald, Jr. ..... F41B 5/1426 124/89
5,016,602 A * 5/1991 Mizek ..... F41B 5/1426 124/89
5,090,396 A * 2/1992 Bickel ..... F41B 5/1426 124/88
5,273,022 A * 12/1993 Leven ..... F41B 5/1426 124/88
5,370,104 A * 12/1994 Neie ..... F41B 5/1426 124/89
5,388,563 A * 2/1995 Hsu ..... F41B 5/1426 124/23.1
5,390,656 A * 2/1995 Villa ..... F41B 5/1426 124/89
5,460,156 A * 10/1995 Sappington ..... F41B 5/1426 124/89
5,471,969 A * 12/1995 McDonald, Jr. ..... F41B 5/1426 124/86
5,511,533 A * 4/1996 Waller ..... F41B 5/1426 124/89
5,595,169 A * 1/1997 Brown, Jr. ..... F41B 5/1426 124/89
5,617,664 A * 4/1997 Troncoso ..... F41A 3/80 124/89
5,669,370 A * 9/1997 Breedlove ..... F41B 5/1426 124/89
5,735,257 A * 4/1998 Walk ..... F41B 5/1426 124/89
5,904,134 A * 5/1999 Denbow ..... F41B 5/1426 124/89
5,975,070 A * 11/1999 Sands ..... F41B 5/1426 124/89
6,021,770 A * 2/2000 Sodaro ..... F41B 5/1426 124/86
6,076,514 A * 6/2000 Adams, Jr. ..... F41B 5/1426 124/89
6,186,135 B1 * 2/2001 Harwath ..... F41B 5/1426 124/89
6,283,109 B1 * 9/2001 Wiseby ..... F41B 5/1426 124/89
6,588,414 B2 * 7/2003 McMillan, III ..... F41B 5/1426 124/88
6,681,755 B2 * 1/2004 Pujos ..... F41B 5/1426 124/89
6,817,352 B1 * 11/2004 Saunders ..... F41B 5/1426 124/89
7,213,590 B2 * 5/2007 Pellerite ..... F41B 5/1426 124/89
7,954,481 B2 * 6/2011 Barnard ..... F41B 5/1426 124/25.6
8,590,522 B2 * 11/2013 Khoshnood ..... F41B 5/1426 124/86
8,695,581 B2 * 4/2014 Felt ..... F41B 5/1426 124/89
8,833,356 B2 * 9/2014 Khoshnood ..... F41B 5/1426 124/86
9,016,268 B2 * 4/2015 Leven ..... F41B 5/1426 124/89
9,038,618 B1 * 5/2015 Bomar ..... F41B 5/1426 124/86
9,733,040 B2 8/2017 Roady et al.
9,909,833 B1 * 3/2018 Huang ..... F41B 5/1426
9,952,014 B2 * 4/2018 Omre ..... F41B 5/1426
10,113,608 B2 * 10/2018 Freyermuth ..... B23B 29/022
10,132,590 B2 * 11/2018 Leven ..... F41B 5/1426
10,648,762 B2 * 5/2020 Jonas, IV ..... F41B 5/1426
2010/0319669 A1 * 12/2010 Grace, Jr. ..... F41B 5/1426 124/88
2012/0240913 A1 * 9/2012 Stokes ..... F41B 5/1426 124/89
2014/0267721 A1 * 9/2014 Stern ..... F41B 5/1492 348/143
2016/0195356 A1 * 7/2016 Roady ..... F41B 5/14 124/87

OTHER PUBLICATIONS

Portion of 1987-1988 Brochure by HHA Sports.
Portion of 1989 Archery Catalog by HHA Sports.
Website screenshot https://www.youtube.com/watch?v=N-ifSGwNQis; uploaded Sep. 3, 2012.

* cited by examiner

ARCHERY BOW STABILIZER

CROSS REFERENCE TO RELATED APPLICATION

This continuation-in-part application claims the benefit of and priority to U.S. application Ser. No. 16/455,321, filed Jun. 27, 2019, which claims the benefit of and priority to U.S. Provisional Patent Application Ser. No. 62/691,055, filed Jun. 28, 2018, the disclosures of which are hereby incorporated by reference herein in their entirety for all purposes.

FIELD

The present disclosure generally relates to archery bows for hunting and target applications, and more particularly to stabilizers for archery bows.

BRIEF DESCRIPTION OF THE DRAWINGS

The accompanying drawing figures, which are incorporated in and constitute a part of the description, illustrate several aspects of a stabilizer, and together with the description, serve to explain the principles of the stabilizer. The following description is based on embodiments of the stabilizer and should not be taken as limiting the stabilizer with regard to alternative embodiments that are not explicitly described herein. A brief description of the figures is as follows.

Figure 1:
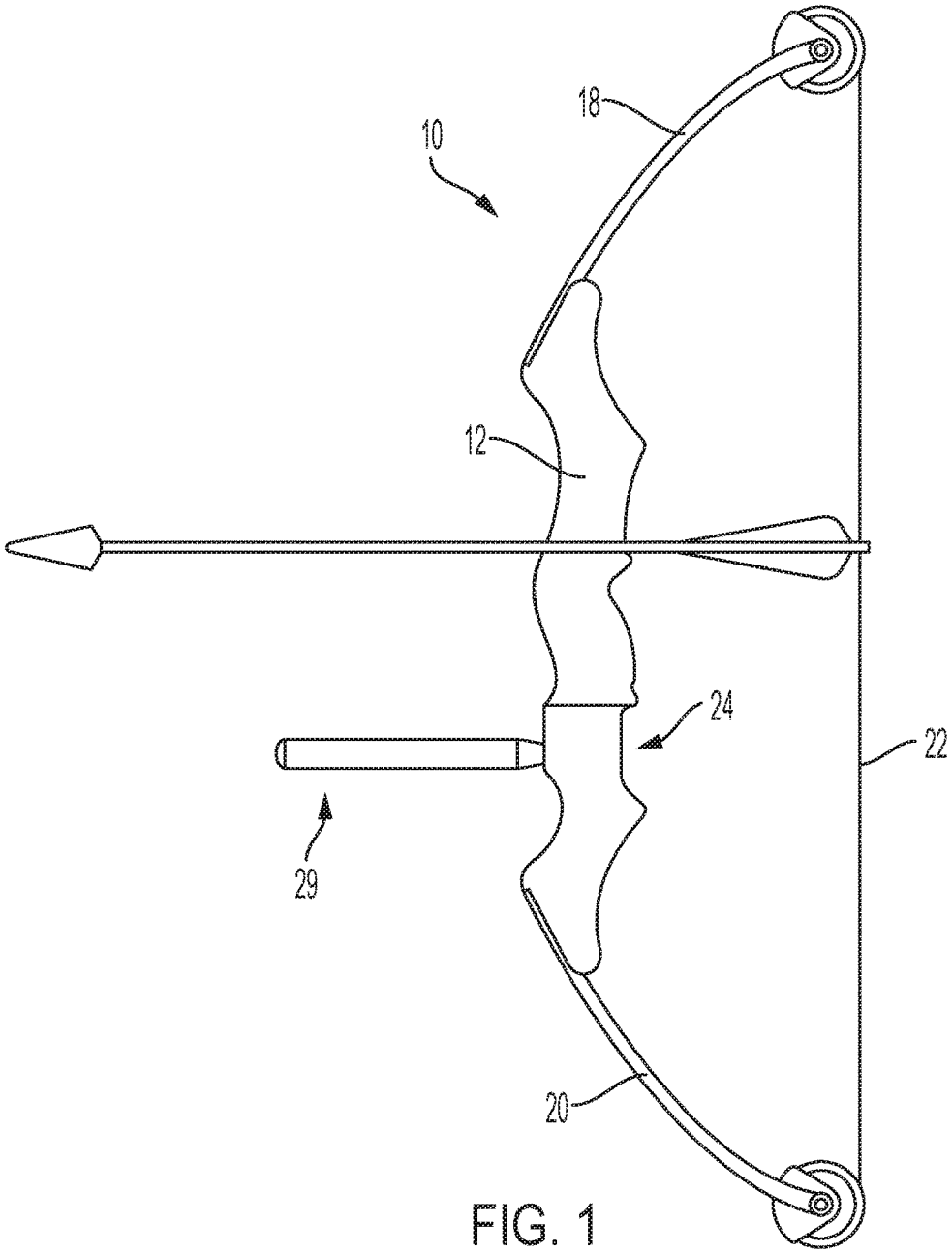
FIG. 1 is a side elevation view of an archery bow with an embodiment of a stabilizer coupled thereto.

In view of the many possible embodiments to which the principles of the stabilizer may be applied, it should be recognized that the embodiments described herein with respect to the drawing figures are meant to be illustrative only and should not be taken as limiting the scope of the invention.

DETAILED DESCRIPTION

Various conventional types of stabilizers are used by archers to improve accuracy by reducing or eliminating vibrations before and after an arrow is released. Some archery bows include dampening components, such as rubber discs, that dampen vibrations caused when shooting the arrow. Furthermore, the stabilizers help the archer achieve balance of the bow. That is, stabilizers help offset weight of the bow in various directions to achieve the balance desired by the archer.

Several factors influence the type of stabilizer utilized by the archer. For example, archery bows may not be manufactured with perfect balance due to manufacturing tolerances and/or defects during molding, machining, and assembling processes. In addition, the archer may add or attach different accessories, such as visual sights, arrow rests, quivers, and grips, to the bow after purchase to aid in shooting accurately. These accessories change the weight and balance of the archery bow. With some conventional stabilizers, additional weights are added to the stabilizer to thereby change the weight and/or balance of the archery bow.

Through research and development, the inventor has determined that archers could benefit from stabilizers that are adjustable and permit the archer to change the balance of the archery bow while in use or "on-the-fly" without additional equipment or components. The present inventor has also observed that many archers strive to find a stabilizer position (e.g. the distance the stablizer's center of gravity is away from the bow) that balances the bow in the shooters hand.

Accordingly, there is a need for a stabilizer that permits an archer to adjust the stabilizer with little effort and without additional tools or components. Furthermore, there is a need for a stabilizer to assist the archer in achieving desired balance of the archery bow and reducing vibrations in the archery bow.

It will be understood by those skilled in the art that one or more aspects of the stabilizer embodiment(s) described below can meet certain objectives, while one or more other aspects can lead to certain other objectives. Other objects, features, benefits and advantages of the stabilizer will be apparent in this description of the disclosed embodiments, and will be readily apparent to those skilled in the art. Such objects, features, benefits and advantages will be apparent from the above as taken in conjunction with the accompanying figures and all reasonable inferences to be drawn therefrom.

Figure 2:
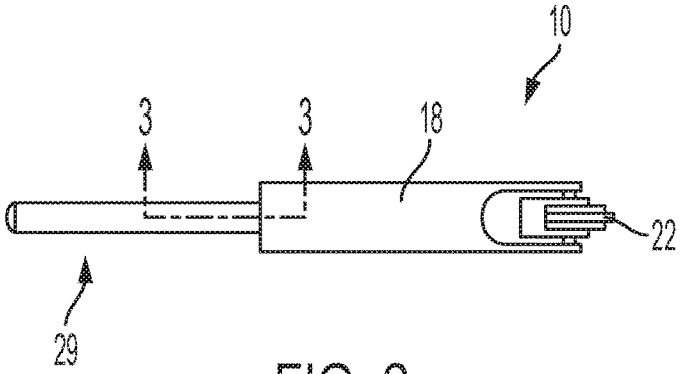
FIG. 2 is a top plan view of the bow and stabilizer of FIG. 1.
Figure 3:
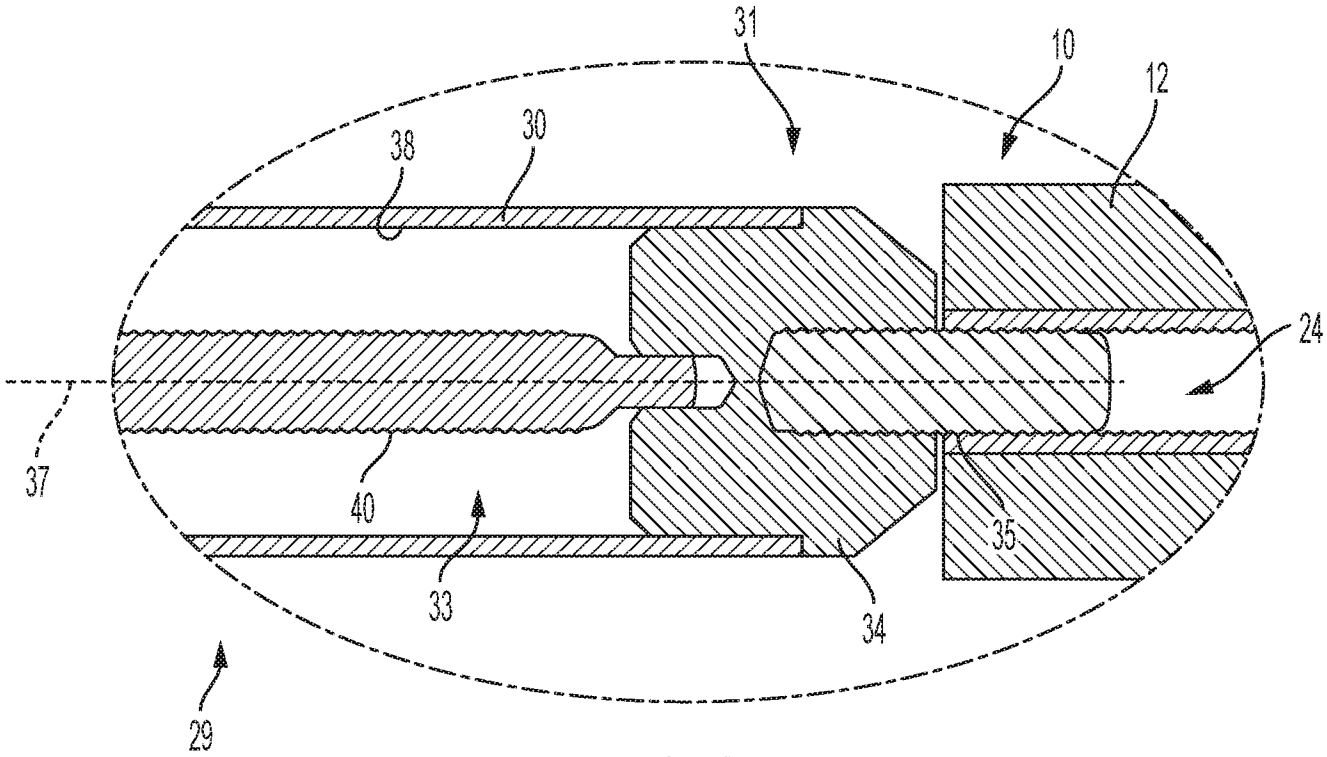
FIG. 3 is an enlarged partial cross sectional view of the archery bow and the stabilizer of FIG. 2 taken along the line 3-3.
Figure 4:
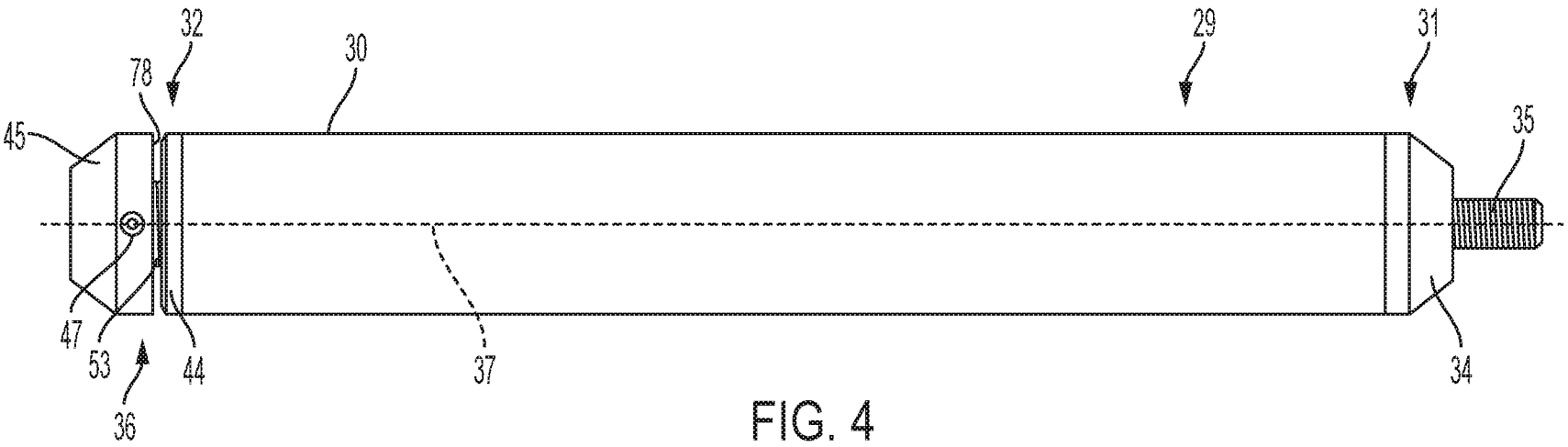
FIG. 4 is a side elevation view of a stabilizer.
Figure 5:
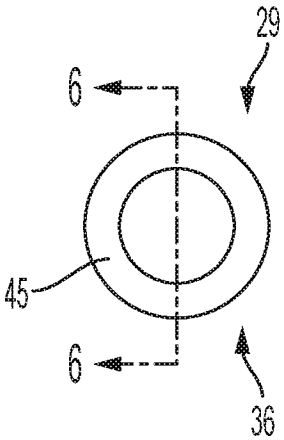
FIG. 5 is an end elevation view of the stabilizer of FIG. 4.

Referring to FIGS. 1-2, an archery bow 10 is depicted with a stabilizer 29. Although one type of archery bow 10, a compound bow, is shown and one specific mounting location is shown, the stabilizer 29 could be used with other types of archery bows, for example a recurve bow, and/or mounted at other locations on the bow, for example in a threaded bore on the opposite side of the handle 12 such that the stabilizer projects towards the string 22, without defeating the spirit of the invention. The archery bow 10 shown in FIG. 1 has a handle 12, an upper arm 18, a lower arm 20, and a string 22 that connects the upper arm 18 to the lower arm 20. As seen in FIG. 3, the handle 12 defines a threaded bore 24 in which a threaded rod or fastener 35 of the stabilizer 29 is received to thereby connect or removably attach the stabilizer 29 to the archery bow 10. The stabilizer 29 is depicted in greater detail in FIGS. 4-6.

Figure 6:
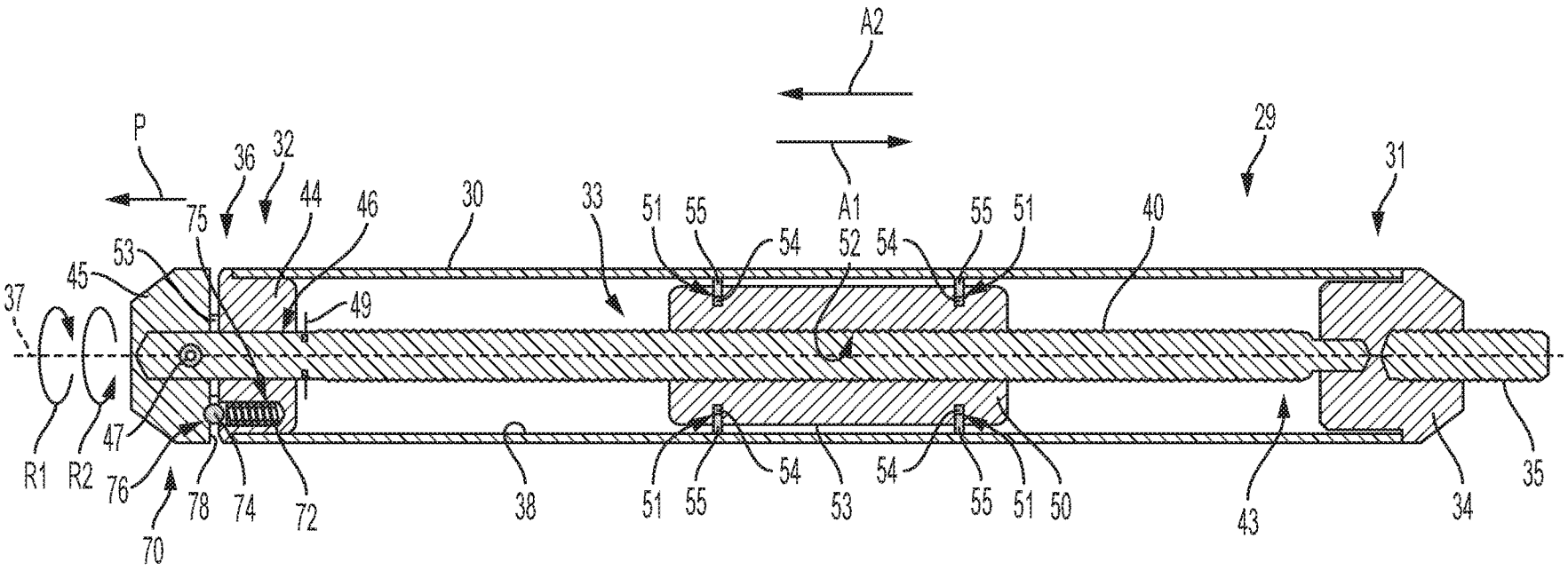
FIG. 6 is a cross sectional view of the stabilizer of FIG. 5 taken along line 6-6.

As seen in FIG. 6, the stabilizer 29 has a tubular housing or frame 30 with an interior surface 38, a first end 31, and an opposite or second end 32. The housing 30 extends along a longitudinal axis 37 and defines an interior cavity 33 elongated between the ends 31, 32 and along the axis 37. The components of the stabilizer 29 described herein can be made out of any suitable material such as plastic, metal, carbon fiber, and the like. In one embodiment, the tubular housing 30 is made from a carbon fiber material.

A fixed cap 34 is fixedly coupled to the first end 31 of the housing 30. In the embodiment seen in FIG. 7, the fixed cap 34 includes spiral grooves for a glue, apoxy or other adhesive such that when the fixed cap is inserted into the tubular frame 30, the glue is not scraped off. However, other means for attaching a cap to a frame is known, for example integrally forming, threads, welding, fasteners, friction, the use of which would not defeat the spirit of the invention. In the embodiment seen in FIG. 6, the fixed cap 34 is partially positioned inside the cavity 33 such that a part of the fixed cap 34 is exposed and/or extends out of the tubular housing 30. The fixed cap 34 includes the threaded rod 35 that connects the stabilizer 29 to the handle 12 of the archery bow 10. In one embodiment, glue, apoxy, adhesive or other fastening means is applied to the threaded rod 35 and the threaded rod is threaded into a threaded hole in the fixed cap 34 to secure the threaded rod to the fixed cap. However, other means are known for securing a threaded rod to a fixed cap, e.g. integral forming, welding, bolting, the use of which would not defeat the spirit of the invention.

An adjustment cap 36 is rotatably coupled to the second end 32 of the housing 30. The second end 32 of the housing 30 has a fixed portion 44. In the embodiment seen in FIG. 6, a part of the fixed portion 44 is positioned inside the cavity 33 and another part of the fixed portion 44 is exposed and/or extends out of the tubular housing 30 at the second end 32. In the embodiment seen in FIG. 7, the fixed portion 44 includes spiral grooves for a glue, apoxy or other adhesive such that when the fixed portion is inserted into the tubular frame 30, the glue is not scraped off. However, other means for attaching a portion to a frame is known, including integrally forming, threads, welding, fasteners, friction, the use of which would not defeat the spirit of the invention. In the embodiment illustrated in FIG. 6, the fixed portion 44 includes a center bore or opening 46 that extends through the fixed portion 44. The adjustment cap 36 further includes an adjustment knob 45 rotatably coupled to the fixed portion 44.

Figure 7:
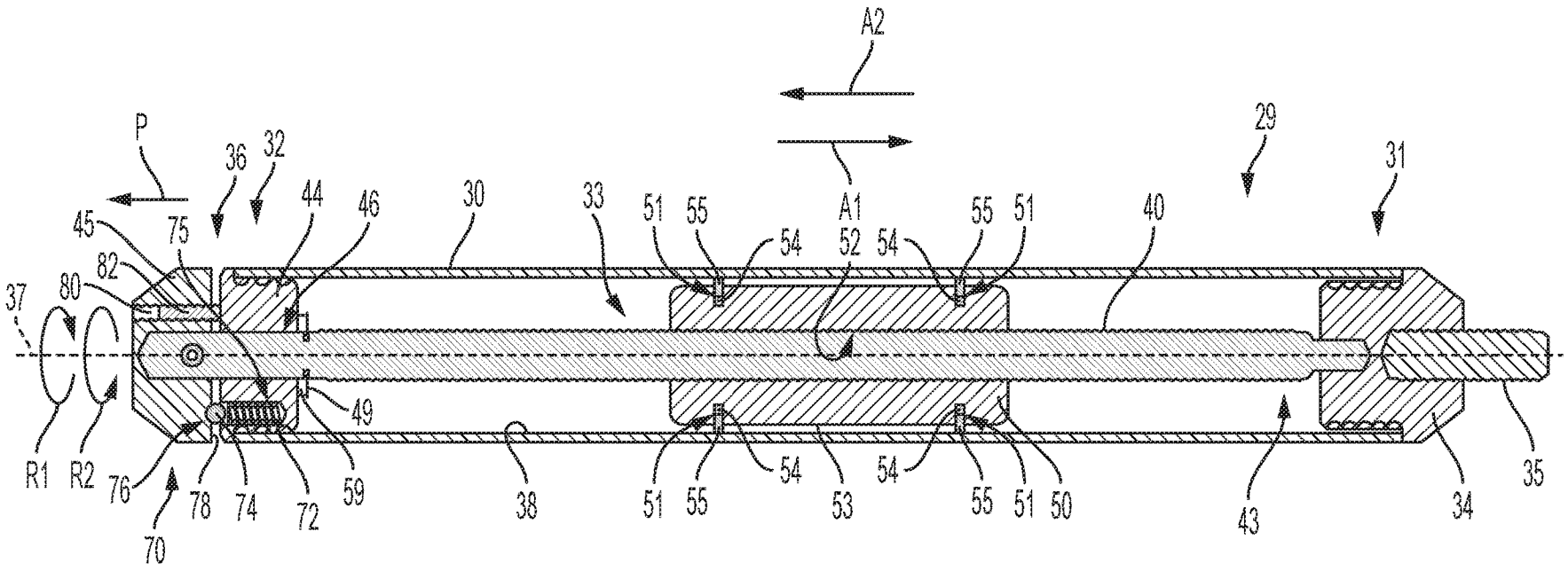
FIG. 7 is a cross sectional view of another embodiment of a stabilizer.

An externally threaded rod or shaft 40 is fixedly coupled or connected to the adjustment knob 45 and extends along the axis 37. In the embodiment seen in FIG. 6, the adjustment knob 45 is attached to the portion of the threaded rod 40 that extends through the bore 46 and out of the housing 30 by a dowel pin 47. However, other means are known for securing a threaded rod to a cap, e.g. threaded insert, integral forming, welding, glue, epoxy, adhesive or other fastening means, the use of which would not defeat the spirit of the invention. A plastic ring or washer 56, for example, an acetal homopolymer material, can be positioned between the adjustment knob 45 and the fixed portion 44, as seen in FIG. 6, or just an air gap, as seen in FIG. 7.

In the embodiment seen in FIG. 6, a snap ring 49 can be placed on the portion of the threaded rod 40 disposed in the interior cavity 33 adjacent the fixed portion 44 to prevent the threaded rod from moving within or being removed from the tubular housing 30. In the embodiment shown in FIG. 7, a washer, for example, made from a polytetrafluoroethene material, is positioned between the snap ring 49 and the fixed portion 44 to prevent a metal component from contacting another metal component. The washer could also be made from a resilient mater, such as rubber, to further improve the dampening ability of the stabilizer.

A first end of the threaded rod 40 extends through the bore 46 of the fixed portion 44 and into the open cavity 33 defined by the housing 30. The threaded rod 40 has a distal or second end 43 (opposite the end that is coupled to the adjustment knob 45) that is rotatably supported by the fixed cap 34. In the embodiment seen in FIG. 6, a portion of the distal end 43 of the threaded rod 40 is rotatably located or held within a bore in the fixed cap 34. In operation, rotation of the adjustment knob 45 causes the threaded rod 40 to rotate within the cavity 33.

An internal weight 50 is positioned in the cavity 33 and has an internally threaded bore 52 in which the threaded rod 40 is received. Although the bore 52 is shown as completely threaded, the bore could be partially threaded. The internal threads of the internal weight 50 engage with the external threads of the threaded rod 40. The weight 50 could alternatively be moved within the cavity 33 by a number of mechanisms know in the art the use of which would not defeat the spirit of the invention. For example, a gearing mechanism could be used instead of a threaded mechanism, such as a worm gear.

The internal weight 50 includes an outer surface 53. A pair of externally recessed grooves 51 are formed in the outer surface 53 of the weight 50. Each of the recessed grooves 51 receives a compressible ring, such as an O-ring 54 and a plastic ring 55. However, more or less recessed grooves, such as seen in the embodiment shown in FIG. 7, could be used without defeating the spirit of the invention. As seen in FIG. 6, the O-rings 54 are positioned between the weight 50 and a plastic ring 55 such that the plastic ring is positioned at least partially within the groove 51 and extends beyond the outer surface 53. The plastic rings 55 are sized to contact the interior surface 38 of the housing 30 and are made from a material that permits the plastic rings to slide along the interior surface. In the embodiment seen in FIG. 6, the O-rings 54 are made from a resilient rubber material and the plastic rings 55 are made from a polytetrafluoroethene material. The O-rings 54 create a bias force on the plastic ring 55 to press the outer surface of the plastic ring 55 against the interior surface 38 of the housing 30. In this embodiment, the combination of the O-rings 54 and plastic rings 55 create a source of friction with or tensile force against the interior surface 38 of the housing 30 to prevent undesired rotation of the threaded rod 40 or the internal weight 50 within the cavity 33 and/or movement along the internal threaded rod 40. Alternatively, just an O-ring, such as a lubricated O-ring, or just a plastic ring could be used, as seen in the embodiment shown in FIG. 7, or other projections, overmolds or other devices to engage or contact the interior surface, without defeating the spirit of the invention.

The combination of the O-rings 54 and plastic rings 55 cushion the internal weight 50 against the interior surface 38 such that the internal weight 50 moves smoothly within the cavity 33. The O-rings 54 and plastic rings 55 also reduce or eliminate rattling between the internal weight 50 and the housing 30. In one embodiment, the plastic rings 55 are a split ring, e.g. the ring has a removed portion, e.g. a notch, to allow the ring to be expanded such that it can be placed around the weight 50 and into the groove 51 where it can contract. The gap or notch in the ring can also allow a first side of the plastic ring 55 to be in fluid contact with a second side of the ring, such as by a passage of air through the plastic ring as the weight 50 moves within the cavity 33 and prevent the buildup of air pressure on either side of the plastic rings 55 during the movement of the weight 50 which allow easier movement of the weight and, thereby, the adjustment knob 45. Although in the embodiment shown in FIG. 6, air is described as being in the interior cavity 33, other materials are known in the art, e.g. oil, shock absorbing gel, foam, etc., the use of which would not defeat the spirit of the invention.

The internal weight 50 is moved along the threaded rod 40 as the adjustment knob 45 is rotated by the archer such that the archer can achieve balance of the archery bow 10. For example, when the adjustment knob 45 is rotated by the archer in a first rotational direction R1 the threaded rod 40 is rotated the first rotational direction R1 and the internal weight 50 is moved in a first axial direction A1 toward the first end 31 and the fixed cap 34. Similarly, when the adjustment knob 45 is rotated by the archer in a second or opposite rotational direction R2, the threaded rod 40 is rotated in the second rotational direction R2 and the internal weight 50 is moved in a second axial direction A2 toward the second end 32 and the adjustment cap 36. Accordingly, the archer can move the internal weight 50 by rotating the adjustment knob 45 until the desired or correct balance of the archery bow 10 is achieved.

In order to prevent the adjustment knob 45 (and the internal weight 50) from inadvertently moving, the adjustment cap 36 is provided with a locking assembly 70 that prevents inadvertent rotation of the adjustment knob 45. In the example depicted in FIG. 6, the locking assembly 70 is incorporated into the adjustment cap 36. In the embodiment shown, the locking assembly 70 includes a spring 72 coupled to the fixed portion 44 that urges a ball bearing 74 toward the adjustment knob 45. In the embodiment seen in FIG. 6, the spring 72 is positioned within a blind bore 75 of the fixed portion 44, such that the ball bearing 74 can be moved between a first portion in which the ball bearing is at least partially retracted into or within the blind bore and a second position in which the ball bearing is at least partially extended out of the blind bore.

The adjustment knob 45 may also have a corresponding detent 76 formed therein that receives at least a portion of the ball bearing 74 when the ball bearing is at least partially extended out of the blind bore 75 and the locking assembly 70 is in a locked position. While in the locked position, the adjustment knob 45 is not free to rotate relative to the fixed portion 44. In order to rotate the adjustment knob 45, a rotational force, sufficient to cause the detent 76 to push the ball bearing 74 toward the fixed portion 44 and thereby compress the spring 72 such that the ball bearing is least partially retracted into the blind bore 75 is applied by the archer to the adjustment knob 45, which is an increase of force as compared to the force when the ball bearing is not in a detent. Accordingly, further rotation of the adjustment knob 45 is then possible and the ball bearing 74 simply rolls along a bearing surface 78 of the knob 45 until the ball bearing 74 is forced back into the detent 76 by the spring 72 after one complete rotation of the adjustment knob 45. In other examples, multiple detents may be provided on the adjustment knob 45 such that the archer can "lock" rotation of the adjustment knob 45 after rotating the adjustment knob 45 less-than one full rotation or detents of different sizes used such that the archer can measure how much rotation is being applied, e.g. feeling four small clicks after one large click.

In an alternative embodiment, the threaded rod 40 could include one or more detents 76 and the blind bore 75 and spring 72 could be positioned perpendicular to the threaded rod such that the threaded rod is the bearing surface 78 for the ball bearing 74.

In the embodiment seen in FIG. 7, the adjustment knob 45 includes a threaded hole 80 and a threaded insert 82 threaded in the hole. When the desired position of the weight 50 is obtained, the threaded insert 82 may be threaded into the threaded hole 80 and into contact with the fixed portion 44. The compressive force applied by the threaded insert 82 and the combination of the snap ring 49 and washer 59, prevent the adjustment knob 45 from further rotation.

In another alternative embodiment, a stabilizer 29 includes a rod or shaft 40 having a portion with a helical groove or threads formed therein and a frame 30 engaged with the threaded rod such that when the frame is rotated, the frame moves axially along the axis 37. In one example of such an embodiment, the threaded rod 40 is held in position while the frame 30 is rotated around the threaded rod.

Figure 11:
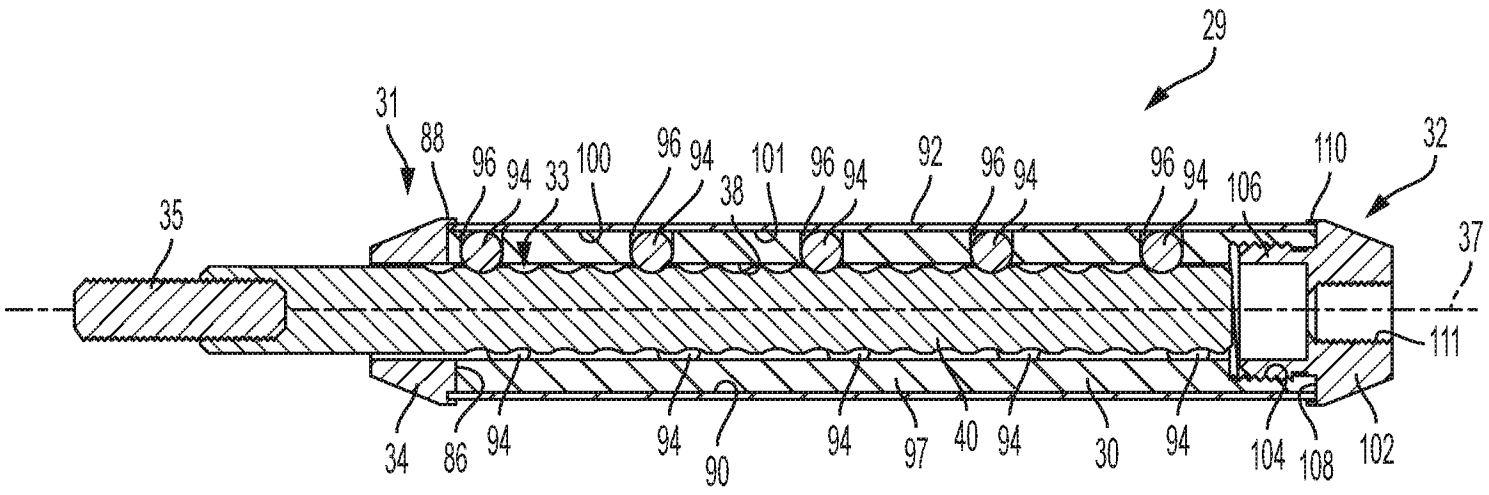
FIG. 11 is a side cross sectional view of the stabilizer of FIG. 9 taken along the line 11-11.

The stabilizer 29 in one embodiment, such as seen in FIGS. 9-14, has a housing or frame 30, such as a tubular housing, with an interior surface 38, a first end 31, and an opposite or second end 32. The housing 30 extends along an axis 37 and defines an interior cavity 33. In FIG. 11, the interior cavity 33 is a through hole extended between the ends 31, 32 and along the axis 37. The components of the stabilizer 29 described herein can be made out of any suitable material such as plastic, metal, carbon fiber, and the like. In one embodiment, the tubular housing 30 is made from a carbon fiber material.

The housing 30 can also include a cap 34 at the first end 31. In the embodiment seen in FIG. 12, the cap 34 includes a through bore 84 that extends through the cap and a recessed portion 86 that forms a lip 88 around the perimeter of one end of the fixed cap. In another embodiment, the cap is separately formed from the tubular housing 30 and the housing is attached to the recessed portion 86 of the cap such as by glue, apoxy or other adhesive. However, other means for attaching a cap to a frame is known, for example, threads, welding, fasteners, friction, the use of which would not defeat the spirit of the invention.

Figure 12:
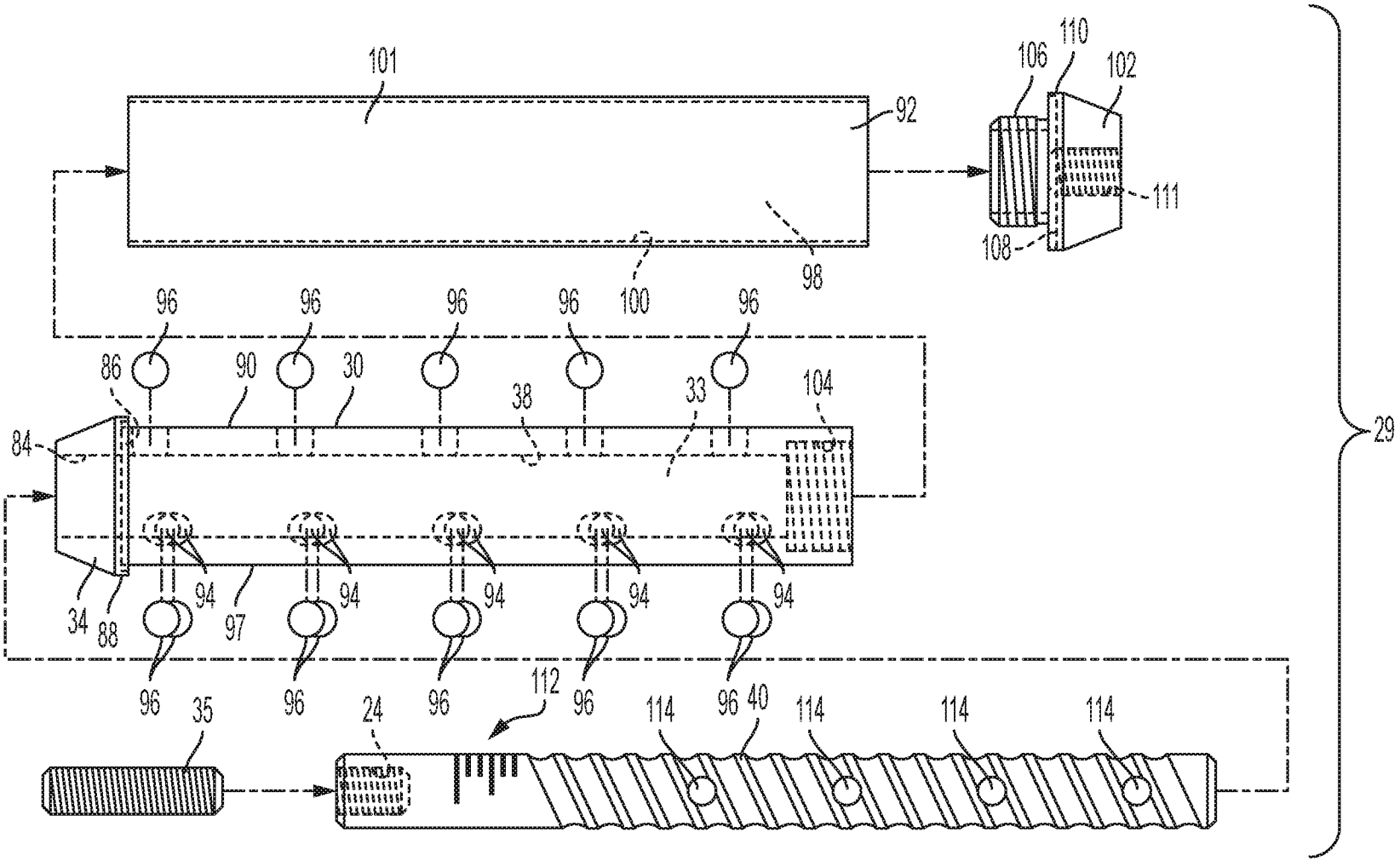
FIG. 12 is a side exploded elevation view of the stabilizer of FIG. 9.
Figure 14:
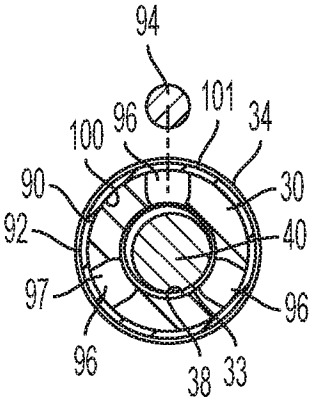
FIG. 14 is an end cross sectional view of FIG. 13 with one ball removed.
Figure 13:
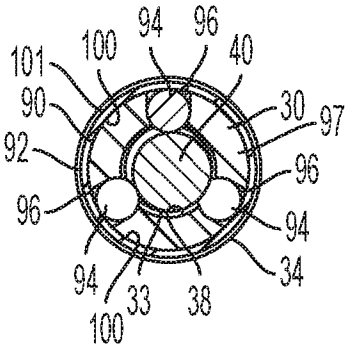
FIG. 13 is an end cross sectional view of the stabilizer of FIG. 9 taken along the line 13-13.

In the embodiment seen in FIG. 12, when the tubular housing 30 is attached to the cap 34, there is a space between the interior surface of the lip 88 and the exterior surface 90 of the tubular housing. This space provides room for the outer sleeve or shell tube 92 as will be discussed further below. The through bore 84 of the cap 34 is sized to receive and/permit the threaded portion of the rod or shaft 40 to extend through and move through the through bore and access or be located at least partially within or inside the cavity 33 of the tubular frame 30. The threaded rod 40 includes a fastener 35 to connect or removably attach the stabilizer 29 to the archery bow 10. In the embodiment seen in FIG. 12, the threaded rod 40 defines a threaded bore 24 in which a threaded stud 35 of the stabilizer 29 is received to attach the stabilizer 29 to the handle 12 of the archery bow 10. In one embodiment, glue, apoxy, or other adhesive is applied to the threaded stud 35 and the threaded stud is threaded into a threaded bore 24 in the threaded rod 40 to secure the threaded stud to the threaded rod. However, other means are known for securing or attaching a threaded stud to a threaded rod, e.g. integral forming, welding, fastening, the use of which would not defeat the spirit of the invention.

The tubular housing 30 can engage the threaded rod 40 such as by a projection or a plurality of projections 94 that extend from the wall 97 into the interior cavity 33 and contact, engage or ride in the threads or helical groove(s) of the threaded rod. In one example, the tubular housing 30 includes one or more holes 96 formed through the frame wall 97 of the tubular housing located between the first end 31 and second end 32. The plurality of holes 96 are sized to receive at least one ball 94 and in the embodiment seen in FIG. 13, a plurality of balls 94. In the embodiment seen in FIG. 13, the holes 96 are a first size which is larger than the balls 94, which are a second size. The holes 96, in cooperation with the size of the wall 97 of the tubular frame, permit a portion of the ball to extend beyond the interior surface 38 and into the cavity 33. In one embodiment, the tubular frame 30 has five sets of holes 96 with each set having three holes for a total of fifteen holes and fifteen rubber balls. The balls can be made from other materials known in the industry, including compressible such as silicone. The portion of the balls 94 extending into the cavity 33 engage the threads or helical groove(s) of the threaded rod 40 when the threaded rod is at least partially within the cavity 33. Using a rubber or other similar material for the balls 94 provides increased dampening and shock absorbing when the bow is fired as well as permitting quiet adjustment. Other means of a housing 30 engaging the threads or a helical groove of a rod are known in the industry, e.g. threaded bore, pins, gears, etc., the use of which would not defeat the spirit of the invention.

As seen in the embodiment illustrated in FIG. 12, a shell tube 92 fits over the tubular frame 30 and within the recessed portion 86 of the cap 34 between the exterior surface 90 of the tubular frame and the lip 88 of the cap. The use of a recessed portion 86 and lip 88 hides the ends of the shell tube 92 and tubular frame 30 and provides a cleaner design. In the embodiment shown in FIG. 12, the shell tube 92 has a the hollow portion, hole or bore 98 of the shell tube 92 that is sized to be slightly bigger than the tubular frame 30, such that the interior surface 100 of the shell wall 101 contacts a second portion of the balls 94 that extend slightly outside of the hole 96 and beyond the exterior surface 90 of the tubular frame when the tubular frame is located at least partially within the bore. The compressive forces of the cap 34 and end cap 102 on the shell tube 92 and the tensile force applied by the balls 94 on the shell tube results in the tubular frame 30 rotating when the shell tube is rotated.

An end or second cap 102 can be coupled or attached to the second end 32 of the tubular frame 30. In the embodiment seen in FIG. 12, the tubular frame 30 includes threads 104 at the second end 32 in the interior surface 38 of the tubular frame. The end cap 102 includes a threaded end, such as a boss, 106 sized to engage the threaded opening 104 to secure the end cap to the tubular frame. The end cap 102 also includes a recessed portion 108 and a lip 110 to receive the ends of the tubular frame 30 and shell tube 92 similar to that described above with respect to cap 34, recessed portion 86 and lip 88. The coupling of the end cap 102 to the tubular frame 30 also helps secure the shell tube 92 to the tubular frame such that when the tubular frame is rotated, the shell tube 92 is rotated. Other means for attaching a portion of a frame to a cap is known, including gluing, epoxying, adhering, integrally forming, welding, fasteners, friction, the use of which would not defeat the spirit of the invention. The end cap 102 may also be used to attached other accessories. For example, the end cap 102 may include a fastener, such as a threaded blind bore 111, as seen in FIG. 12, to receive or attach other accessories such as weights, dampers or a video camera or bracket or the same. Other means are known for attach accessories to a stabilizer, for example, hooks and loops, straps, magnets, hooks, etc., the use of which would not defeat the spirit of the invention.

In one embodiment the weight of the shell tube 92 and housing 30 provide the weight that can be moved to adjust the center of gravity of the bow. However, in other embodiments or if additional weight is needed, such weight can be attached to end cap 102 as described above.

The stabilizer 29 may be attached to a bow 10, such as by threading the threaded stud 35 into the threaded bore 24 in the handle 12 of the bow. Once the stabilizer 29 is attached, an archer may rotate the shell tube 92. Rotation of the shell tube 92 will result in rotation of the cap 34, end cap 102, tubular frame 30 and the balls 94 located in the holes 96 in the wall 97 of the tubular frame. The portion of the balls 94 extending beyond the interior surface 38 of the wall 97 and into the cavity 33 engage the threads of the threaded rod 40. As the shell tube 92 is rotated, the tubular frame 30 and balls 94 move around and axially along the threaded rod 40 and the axis 37.

For example, rotation in a first direction, e.g. clockwise, results in the tubular frame 30, shell tube 92, cap 34 and end cap 102 moving along the longitudinal axis 37 towards the threaded stud 35. Rotation in the first direction results in more of the threaded rod 40 being located within the interior cavity 33. Rotation in a second direction, e.g. counterclockwise, results in the tubular frame 30, shell tube 92, balls 96, cap 34 and end cap 102 moving along the longitudinal axis 37 away from the threaded stud 35. Rotation in the second direction results in less of the threaded rod 40 being located within the interior cavity 33. Advantages of the rotational movement described above include the ability to make very small, fine or micro adjustments or movements of the tubular frame 30, shell tube 92, cap 34 and end cap 102, which permits precise adjustability and the ability to return to a specific location.

The threads of the threaded rod 40 can stop before the second end 32 of the threaded rod such as seen in FIG. 12. This prevents the balls 94 from being rotated past the end of the threads and the tubular frame 30, shell tube 92, cap 34 and end cap 102 from being rotated off the threaded rod.

One advantage of the stabilizer shown in FIGS. 9-14 is that an archer can determine how much the stabilizer has been rotated by observing how far the shell tube 92 and/or cap 34 is away from the bow 10 or the threaded stud 35. A portion of the threaded stud 40 adjacent the first end 31 may not have threads and may include markings 112, such as numbers, dots, lines, etc., to indicate at what position the stabilizer is located. For example, the markings 112 could indicate how far the shell tube 92 and/or cap 34 is away from the bow 10 or the threaded stud 35 or how many times the shell tube 92 has been rotated. The markings permit even more precise accounting of the movement of the stabilizer.

The stabilizer may also, or alternatively, include a locking mechanism that reduces inadvertent rotation of shell tube 92. In the example depicted in FIG. 12, the threaded rod 40 includes at least one detent 114 and, in one embodiment four detents. The detents are located in the portion of the threads on the rod 40 in which the balls 94 travel. When one of the balls 94 reaches a detent 114, the force applied by the shell tube 92 causes the ball to sit or be located in the detent.

In order to rotate the shell tube 92, a rotational force, sufficient to cause the ball 94 to exit the detent 114 and into compression between the threaded rod 40 and the shell tube 92 is applied by the archer to the shell tube 92, which is an increase of force as compared to the force when the ball bearing is not in a detent. Accordingly, further rotation of the shell tube 92 is then possible and the ball 94 simply moves along the threaded surface of the threaded rod 40. The interaction between the ball(s) 94 and the detent(s) 114 may also be felt by the archer when rotating the shell tube 92. This presents another way to measure and/or determine how much the stabilizer has been rotated. For example, a detent may indicate a third of a rotation. Alternatively, larger and small detents could be used to indicate full and partial rotations to the archer, e.g. feeling four small clicks after one large click.

Figure 15:
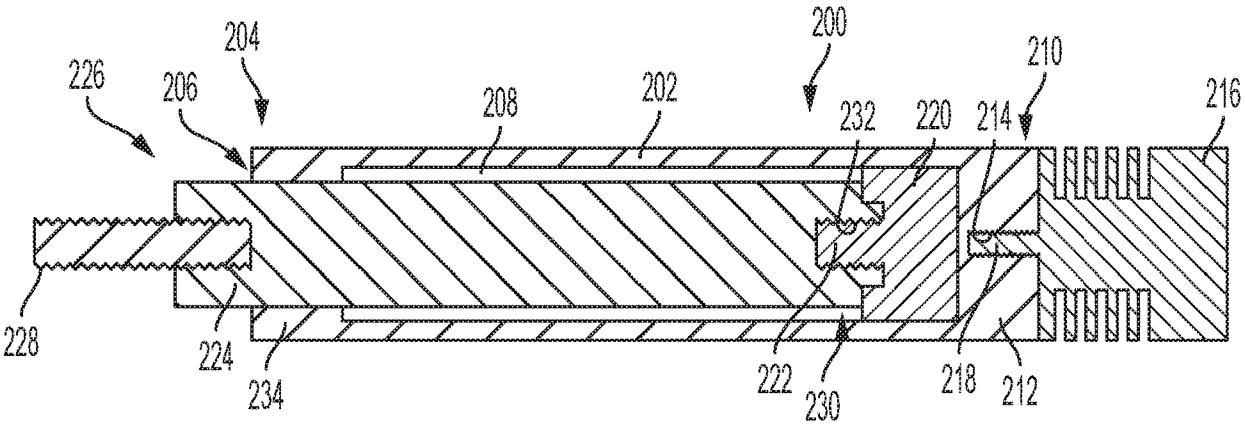
FIG. 15 PRIOR ART
FIG. 15 is a side cross sectional view of a prior art stabilizer in a first position.
Figure 16:
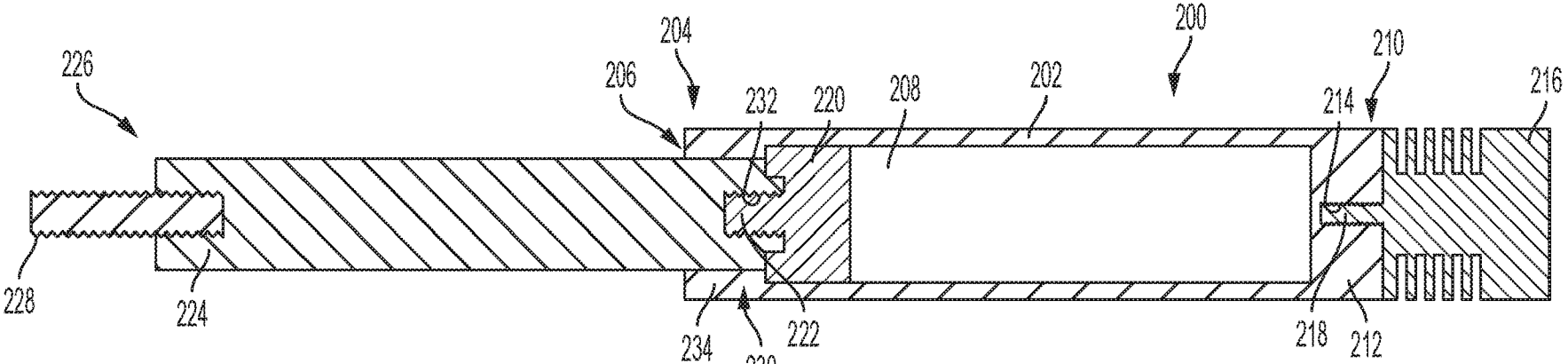
FIG. 16 PRIOR ART
FIG. 16 is a side cross sectional view of a prior art stabilizer in a second position.

Bowtech, Inc., doing business as Octane Accessories, makes an adjustable stabilizer, a general drawing of which can be seen in FIGS. 15-16. The stabilizer 200 in FIG. 15 has a tube-shaped enclosure 202. A first end 204 of the enclosure 202 has an opening 206 to provide access to the interior cavity 208 of the enclosure. The second end 210 has a wall 212. The end wall 212 has a threaded bore 214. Weighted damper 216 can be attached to the stabilizer 200 by screwing the threaded post 218 of the weighted damper 216 into the threaded bore 214.

A piston 220 is located inside the interior cavity 208 of the enclosure 202. The piston 220 includes a threaded post 222. A plunger 224 is received through the opening 206 of the enclosure 202 and into the interior cavity 208. A first end 226 of the plunger 224 has a threaded post 228 for attaching the stabilizer 200 to an archery bow. The second end 230 of the plunger 224 has a threaded bore 232 for receiving the threaded post 222 of the piston 220 to attach the plunger to the piston.

When the stabilizer 200 is attached to a bow, the enclosure 202 can be pulled away from the bow and the threaded post 228. When the enclosure 202 is pulled away, the opening 206 of the enclosure will slide along the plunger 224 until the lip 234 of the enclosure forming the opening contacts the plunger 220 as seen in FIG. 16. Pulling the enclosure 202 away, exposes more of the plunger 224 and locates the weighted damper 216 further away from the bow. When the enclosure 200 is pulled towards the bow, the piston 220 slides further into the cavity 208 until the piston contacts the wall 212 of the enclosure, as seen in FIG. 15. Pulling the enclosure 202 towards the bow, exposes less of the plunger 224 and locates the weighted damper 216 closer to the bow. An archer may move the enclosure to a desirable position between the piston 220 contacting the lip 234 and the piston contacting the wall 212.

The prior art stabilizer 200 suffers a number of disadvantages. The prior art stabilizer 200 may be inadvertently moved such as by the enclosure 202 being bumped by a branch while walking in the woods to a hunting location. It is also difficult to repeatably and precisely move the enclosure 202 to a specific position. It is also difficult to move the enclosure 202 in very small amounts, e.g. micro-adjustment.

Figure 8:
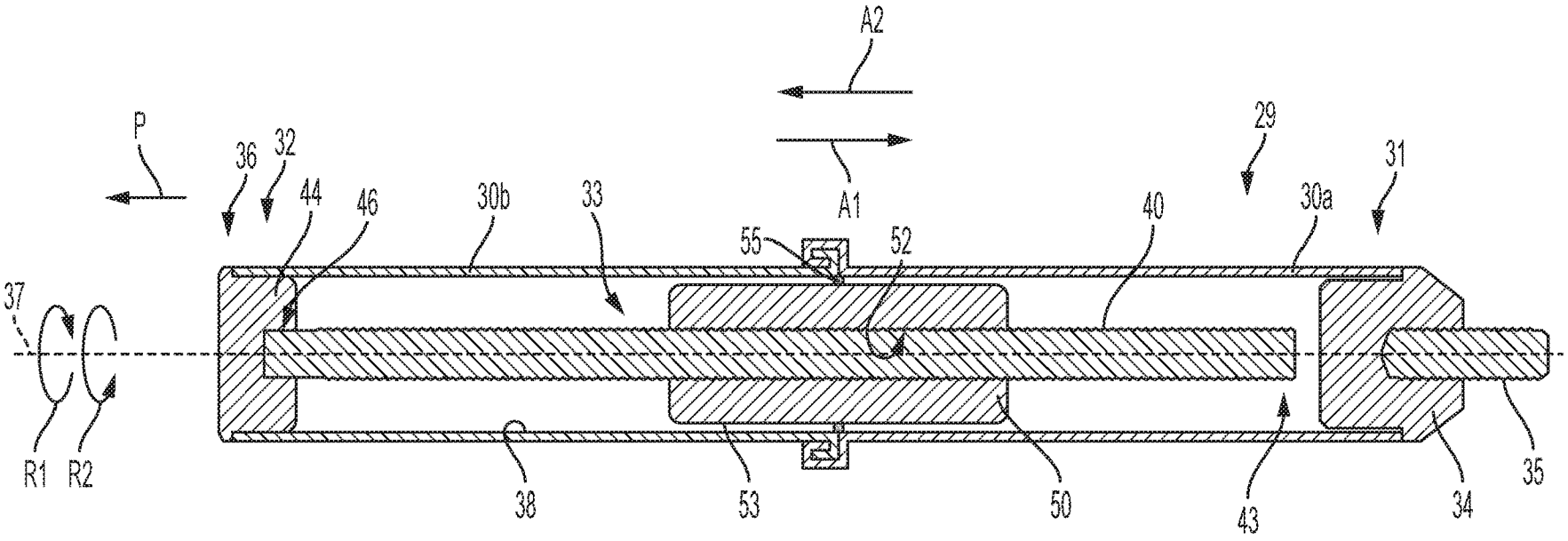
FIG. 8 is a cross sectional view of another embodiment of a stabilizer.
Figure 9:
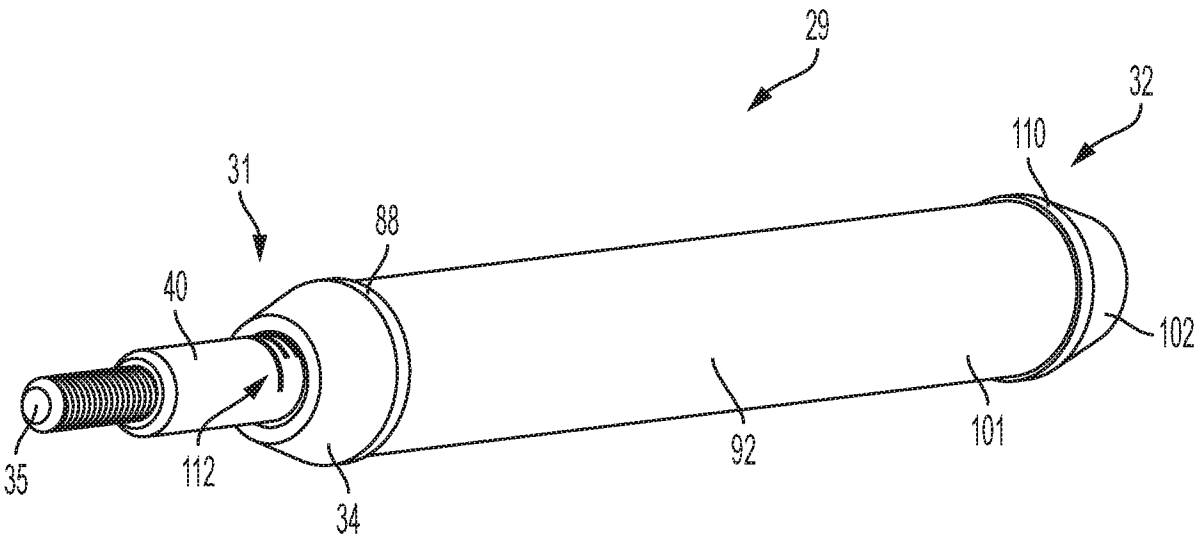
FIG. 9 is a perspective view of another embodiment of a stabilizer.
Figure 10:
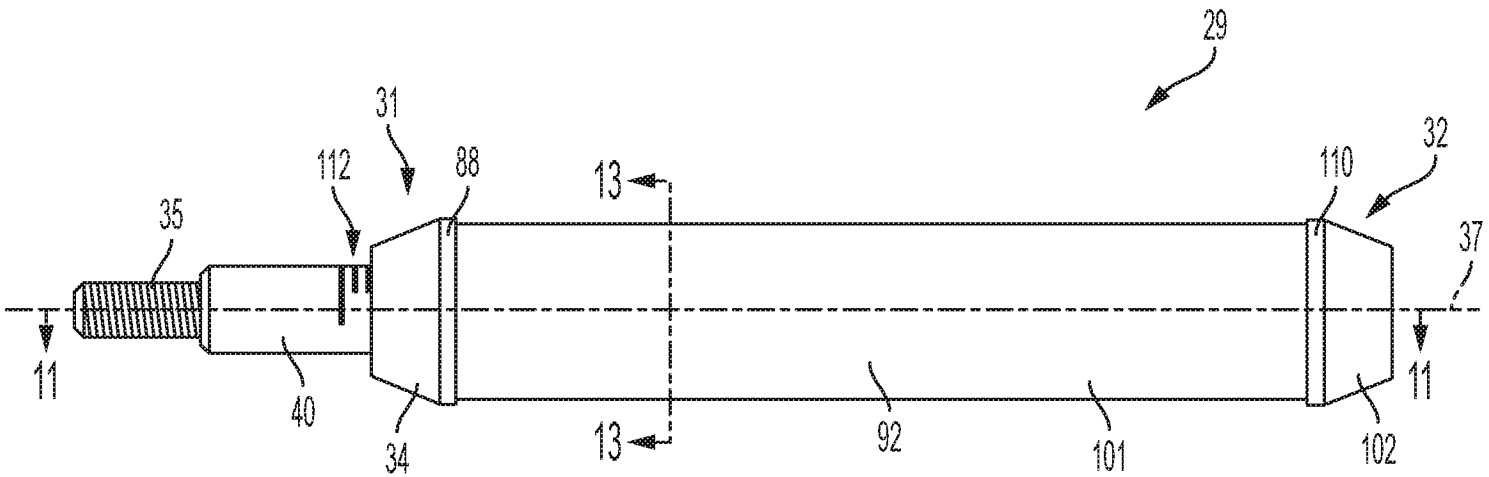
FIG. 10 is a side elevation view of the stabilizer of FIG. 9.

This written description uses examples to disclose the invention, including the best mode, and also to enable any person skilled in the art to make and use the invention. The patentable scope of the invention is defined by the claims, and may include other examples that occur to those skilled in the art. For example, the threaded rod 40 need not be held in the cap 34 as the weight 50 may sufficiently hold the threaded rod as seen in FIG. 8. By way of another example, the tubular housing 30 could have a first part 30*a* and a second part 30*b* which are rotatably connected as shown in the embodiment seen in FIG. 8. The threaded rod 40 could be fixedly connected or secured to the second part 30*b* such that when the second part is rotated, the threaded rod is rotated and the weight 50 moved along an axis between the first and second end 32. For example, when the second part is rotated in the first direction, the weight is moved closer to the first end, and when the second part is rotated in the second direction, the weight is moved closer to the second end.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, it is to be understood that in at least some embodiments, plurality can include one or more of an element.

What is claimed is:

1. A stabilizer for an archery bow comprising:

a frame forming an interior cavity and having a longitudinal axis;

a threaded rod located at least partially within the interior cavity;

a fastener configured to attach the stabilizer to the archery bow;

a shell tube having a shell wall forming a bore;

a ball located in a hole formed in a frame wall of the frame;

wherein the frame is located at least partially within the bore;

wherein the bore is configured such that an interior surface of the shell wall contacts a portion of the ball; and wherein the frame engages the threaded rod such that when the frame is rotated in a first direction, the frame is moved along the longitudinal axis toward a first end of the threaded rod and when the frame is moved in a second direction, the frame is moved along the longitudinal axis away from the first end.

2. The stabilizer of claim 1, wherein when the frame is rotated in the second direction, less of the threaded rod is located within the interior cavity and when the frame is moved in the first direction, more of the threaded rod is located within the interior cavity.

3. The stabilizer of claim 1, wherein a second portion of the ball extends beyond the frame wall and into the interior cavity;

wherein the frame engages the threaded rod by the second portion of the ball engaging threads of a portion of the threaded rod located in the interior cavity;

wherein when the frame is rotated in the first direction, the ball moves around the threaded rod in the first direction and when the frame is moved in the second direction, the ball is moved around the threaded rod in the second direction.

4. The stabilizer of claim 1, wherein the hole is a first size and the ball is a second size and the first size is larger than the second size.

5. The stabilizer of claim 4, wherein the frame wall has an interior surface forming the interior cavity and an exterior surface opposite the interior surface and wherein the portion of the ball extends beyond the exterior surface.

6. The stabilizer of claim 1, wherein the interior surface of the shell wall contacts the portion of the ball such that the ball is compressed.

7. A stabilizer for a bow, the stabilizer comprising:

a tubular housing having a wall; the wall having an interior surface forming a through hole and exterior surface;

a plurality of projections that extend from the interior surface into the through hole;

a non-hollow shaft having a fastener and a portion with a helical groove formed therein, the portion of the shaft with a helical groove located at least partially inside the through hole;

wherein when the plurality of projections engage the helical groove such that when the tubular housing is rotated, the tubular housing is moved axially along the shaft; and wherein the plurality of projections are a plurality of balls and wherein each of the plurality of balls are located in a hole formed in the wall of the tubular housing.

8. The stabilizer of claim 7, further comprising an outer sleeve with a bore and wherein a portion of the tubular housing is located in the bore.

9. The stabilizer of claim 8, further comprising a cap having a through bore;

wherein the cap is attached to a first end of the tubular housing; and wherein a portion of the shaft extends through the through bore.

10. The stabilizer of claim 9, wherein an end of the portion of the shaft that extends through the through bore has a fastener and wherein the fastener is configured to attach the shaft to the bow.

11. The stabilizer of claim 9, further comprising a second cap attached to a second end of the tubular housing, the second cap having a second fastener configured to attach accessories to the stabilizer.

12. The stabilizer of claim 11, wherein the second fastener is a threaded bore formed in the second cap.

13. A stabilizer comprising:

a frame having a cavity;

a rod further comprising:

a first end;

a second end opposite the first end, the second end of the rod located in the cavity;

a threaded portion; and a non-threaded portion located adjacent the first end a threaded stud attached to the first end of the rod, the threaded stud configured to attach the rod to a bow;

a plurality of balls located in the cavity and engaged with the threaded portion of the rod;

wherein the frame is spaced apart from the rod by the plurality of balls; and wherein when the frame is rotated, the plurality of balls rotate around the threaded portion of the rod and the frame moves axially along the rod.

14. The stabilizer of claim 13, wherein the frame has a wall and the wall has a plurality of holes and wherein each of the plurality of balls are located in one of the plurality of holes.

15. The stabilizer of claim 13, further comprising an end cap attached to the frame, the end cap having a threaded bore formed therein.

16. The stabilizer of claim 15, wherein the end cap has threaded end and the threaded end is located in a threaded opening of the frame.

17. The stabilizer of claim 13, wherein the non-threaded portion of the rod includes markings configured to indicate a position of the frame.

18. The stabilizer of claim 17, further comprising a cap attached to the frame, the cap having a hole formed therein and configured to permit the rod to move through the hole.

19. The stabilizer of claim 13, wherein at least one detent is formed in the threaded portion of the rod and wherein the detent is configured to receive one of the plurality of balls when the frame is rotated.

20. The stabilizer of claim 13, wherein the plurality of balls are configured to dampen vibrations when the bow is fired.

* * * * *